United States Patent [19]

Okamoto

[11] 4,055,021

[45] Oct. 25, 1977

[54] TOY CAR RACER WITH SELF-STEERING MECHANISM

[75] Inventor: Shozo Okamoto, Tokyo, Japan

[73] Assignee: Yonezawa Toys Co., Ltd., Tokyo, Japan

[21] Appl. No.: 676,797

[22] Filed: Apr. 14, 1976

[30] Foreign Application Priority Data

Apr. 18, 1975 Japan ..... 50-52760

[51] Int. Cl.[2] ..... A63H 18/16

[52] U.S. Cl. ..... 46/202; 46/211; 46/213; 46/251; 273/86 R

[58] Field of Search ..... 46/213, 251, 257, 260, 46/261, 262, 1 K, 202, 210–213; 273/86 R, 86 B

[56] References Cited

U.S. PATENT DOCUMENTS

| | | | |
|---|---|---|---|
| 2,109,403 | 2/1938 | Roussy et al. | 46/262 X |
| 3,307,292 | 3/1967 | Fileger | 273/86 B |
| 3,750,833 | 8/1973 | Kahl | 46/262 |

*Primary Examiner*—Louis G. Mancene
*Assistant Examiner*—Robert F. Cutting
*Attorney, Agent, or Firm*—Young & Thompson

[57] ABSTRACT

A toy car racer in combination with a roadbed on which said toy car racer travels in random contacts with upright side guide walls provided along opposite marginal ends of the roadbed in which either of the front or the rear wheels of the toy car is associated with a self-steering mechanism including symmetrically arranged retractable arms whereas the other two wheels are associated with a propelling means and the upright side guide walls are provided with a plurality of barrier means adapted to engage with the projected arms of the self-steering mechanism thereby to change the advancing direction of the toy car racer.

8 Claims, 5 Drawing Figures

TOY CAR RACER WITH SELF-STEERING MECHANISM

This invention relates to a toy car racer and more particularly to a toy car racer having a self-steering mechanism.

In toy car racers known heretofore, a roadbed on which the toy car travels is provided with a pair of electrical paths with a guide channel arranged therebetween and the toy car at its bottom is provided with a pin projected therefrom to engage with the guide channel for leading the toy car therealong. While, in the toy car racer or another type, the roadbed is free from the guide channel but in lieu thereof the upstanding side guide walls are provided along the opposite ends of the roadbed whereas the front wheels of the toy car are somewhat turned in a deflected direction so that the toy car racer travels in contact with the upstanding side guide walls. However, according to these conventional toy car racers it is difficult to change selectively or optionally the advancing direction of the travelling toy car racer.

It is, therefore, a general object of the present invention to provide a toy car racer with a self-steering mechanism which is operated in cooperation with the roadbed arrangement.

In accordance with the present invention, there is provided a toy car racer in combination with a roadbed on which said toy car racer travels in random contacts with upright side guide walls provided along opposite marginal ends of the roadbed in which either of the front or the rear wheels of the toy car is associated with a self-steering mechanism including symmetrically arranged retractable arms whereas the other two wheels are associated with a propelling means and the upright side guide walls are provided with a plurality of barrier means adapted to engage with the projected arms of the self-steering mechanism thereby to change the advancing direction of the toy car racer.

At least one of the arms may be connected to a slider which is extensible from the rear end of the toy car racer. For example, when the front wheels are turned to the left, the slider at its one end is extended from the rear end of the car body. When the succeeding toy car racer comes close to the preceding toy car and pushes the extended end of the slider for retraction thereof, then the front wheels are turned to the right so that the succeeding toy car can outrun the deflected preceding car with the convenient speed controls of both toy cars.

It is, therefore, another aspect of the invention to provide a toy car racer in combination with a roadbed on which said toy car racer travels in random contacts with upright side guide walls provided along opposite marginal ends of the roadbed in which either of the front or the rear wheels of the toy car is associated with a self-steering mechanism including symmetrically arranged retractable arms whereas the other two wheels are associated with a propelling means, at least one of said arms being connected to a slider means which at its one end is extensible from the rear end of the toy car racer and the upright side guide walls are provided with a plurality of barrier means adapted to engage with the projected arms of the self-steering mechanism thereby to change the advancing direction of the toy car racer.

Other objects and advantages of the present invention will become apparent as detailed description thereof proceeds.

For a fuller understanding of the present invention, reference should now be had to the following detailed description thereof taken in conjunction with the accompanying drawings in which.

Figure 3:
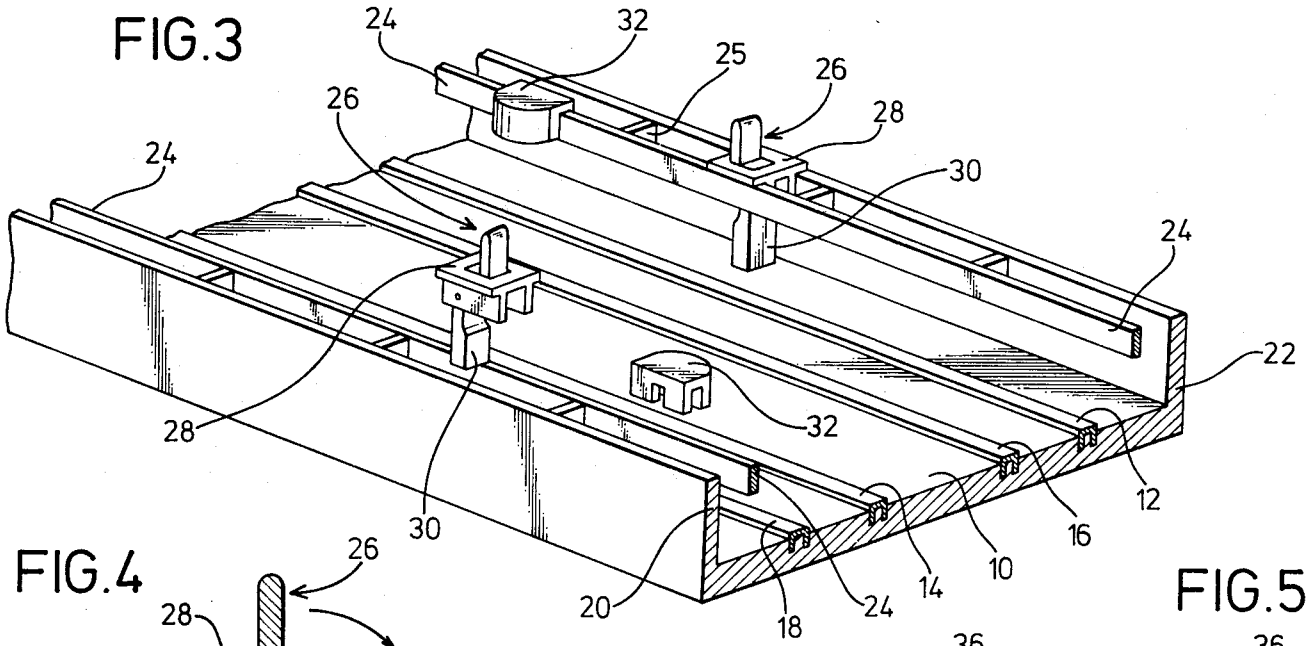
FIG. 3 is a partial perspective view of a roadbed in accordance with the present invention.

In FIG. 3, the reference numeral 10 stands for a roadbed which is provided with positive electric paths 12 and 14 and negative electric paths 16 and 18. As a power to be applied DC current is usually applied to the electrical paths, notwithstanding the known half-wave rectification current may also be used, for example, by applying one AC current to the electrical paths 12 and 16 and another AC current of different phase to the electrical paths 14 and 18.

Figure 4:
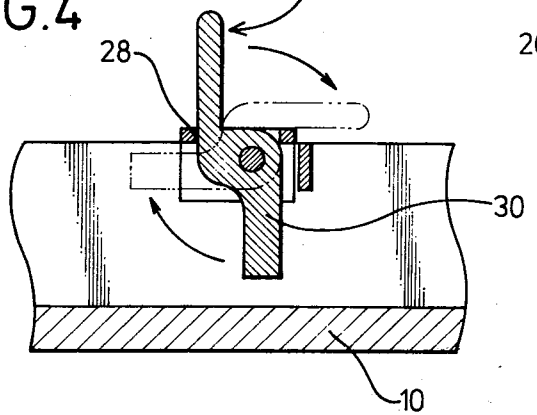
FIG. 4 is a fragmentarily enlarged side view partially sectioned of the barrier means provided along the upright side guide walls of the roadbed of FIG. 3.

The roadbed 10 along its opposite marginal ends is provided with the upstanding side walls 20, 22 which support elongated guide plates 24, 24 respectively through spacers 25 and between the side walls 20, 22 and the guide plates 24, 24 are detachablly provided operational barrier means 26 at the desired distance. The operational barrier means is typically comprised of a bracket 28 and a turnable lever 30 pivoted thereto as best shown in FIG. 4.

Between the side walls 20, 20 and guide plates 24, 24 are further releasably provided a stationary barrier 32 having a rounded surface. This barrier 32 serves such that when the toy car racer traveling on the roadbed collides with the stationary barrier 32 it is temporally deflected from its normal track and during this deflection the succeeding toy car racer outruns the deflected preceding car uner the predetermined speed control of the cars.

Figure 1:
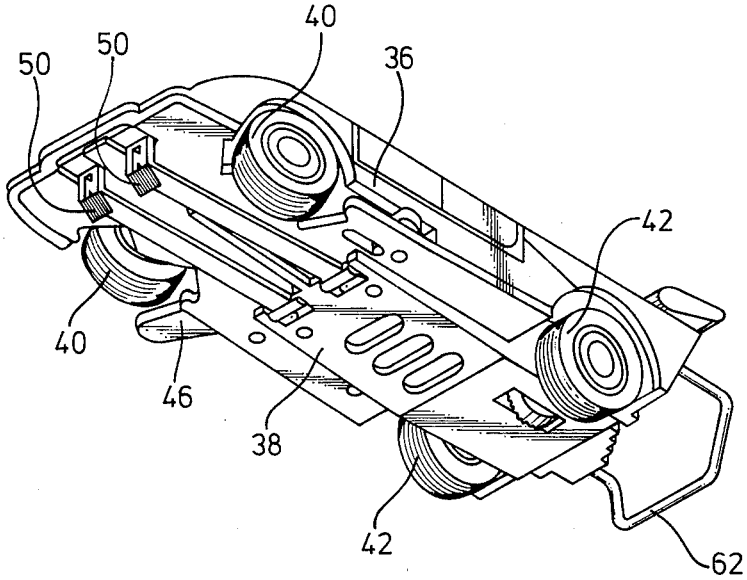
FIG. 1 is a perspective view of a toy car racer according to the invention.
Figure 2:
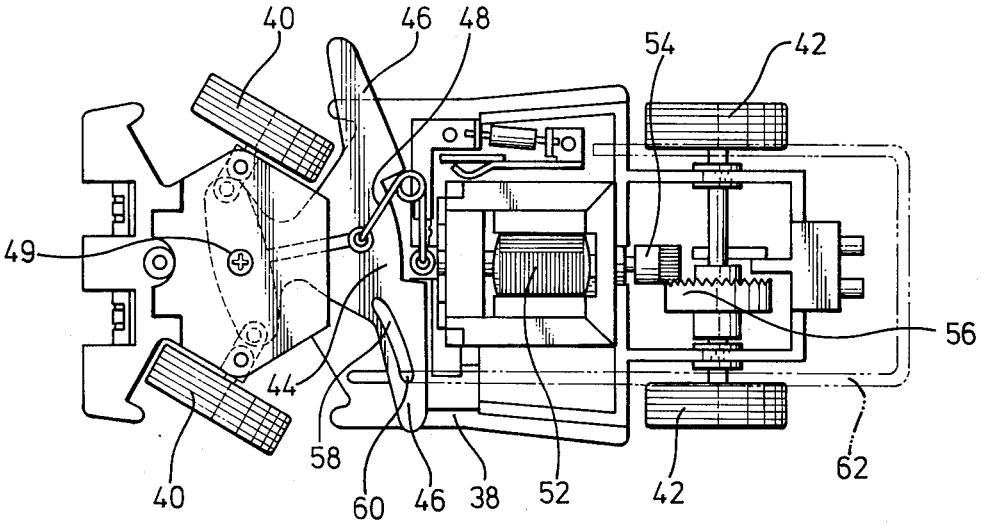
FIG. 2 is a bottom view of the chassis of the toy car racer of FIG. 1.

Now back to FIGS. 1 and 2, the toy car racer according to the present invention comprises a body 36 and a chassis 38 with front and rear wheels 40, 40 and 42, 42. The front wheel 40, 40 are associated with a self-steering mechanism which comprises a swivel plate 44 having two arms 46, 46 which are alternately projectable from opposite sides of the toy car racer. The plate 44 at its one end is resiliently engaged with a spring pin 48 which serves to retract the arms 46, 46 alternately when the one of the arms collides with the turnable lever 30 of the operational barrier thereby to change the advancing direction of the traveling toy car racer. The opposite end of the plate 44 is pivoted to the chassis 38 through a pivot pin 49 and loosely connected to the front wheels 40, 40.

The reference numeral 50 represents brush contacts which are electrically connected to a motor 52 which is in turn connected to the rear wheels 42, 42 through a pinion 54 and a crown 56.

As best shown in FIG. 2, one of the arms 46 is formed with a guide groove 58 in which a pin 60 is loosely engaged. The pin 60 is connected to one end of the slider 62 which is slidably arranged in the car body 36. As hereinbefore described, when the front wheels 40, 40 with the arms 46, 46 are turned to the left, the slider 62 at its opposite end is extended from the rear end of the car body 36. When the succeeding toy pushes the extended end of the slider 62 for retraction thereof, the arm 46, 46 with the front wheels 40, 40 are turned to the right thereby to deflect the preceding car to the right so that the succeeding car outruns the deflected preceding car.

Figure 5:
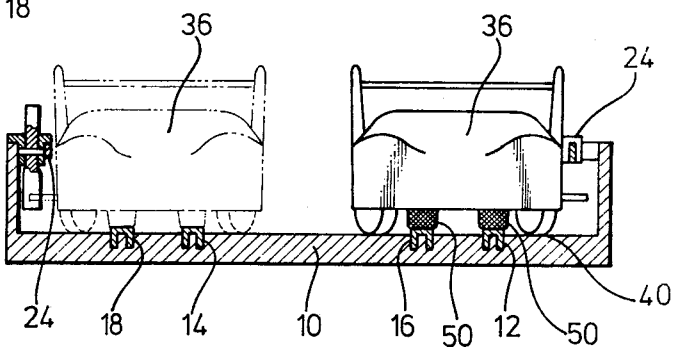
FIG. 5 is a front elevation of the toy car racer placed on the roadbed.

In the operation of the toy car racer according to the present invention, when the front wheels 40, 40 are directed to the left as best shown in FIG. 5 in solid line, the toy car advances in turning toward the left and slides along the left side guide plate 24 until the arm 46 collides with the turnable lever 30 of the operational barrier 26. When the toy car racer collides with the stationary barrier 32, it is temporally deflected to the right.

Since, however, the front wheels 40, 40 are still directed to the left the toy car racer again comes close to the guide plate 24 on the left side and travels until one of the arms 46, 46 collides with the operational barrier lever 30 for retraction of the arm 46 thereby to change the advancing direction of the car to the right.

In accordance with the present invention, the racing play with several toy car racers may be enjoyed by a simple manual operation of the operational barriers and also controlling the power to be applied on the electrical paths of the roadbed without, however, causing undesired car crush.

While a certain preferred embodiment of the invention has been illustrated by way of example in the drawings and particularly described, it will be understood that various modifications may be made in the structure and arrangements and that the invention is in no way limited to the embodiment shown.

What is claimed is:

1. A toy car racer in combination with a roadbed on which said toy car racer travels in random contacts with upright side guide walls provided along opposite marginal sides of the roadbed, the racer having two steerable wheels and two driven wheels, steering mechanism for said steerable wheels comprising a pair of arms mounted for swinging movement on the vehicle between a position in which one of said arms projects to one side of the vehicle and the steerable wheels are turned in one direction, and another position in which the other of said arms projects from the other side of the vehicle and the wheels are turned in the opposite direction, and barrier means along said roadbed adapted to engage one or the other of said arms on one or the other side of the vehicle thereby to change the advancing direction of the toy car racer.

2. Apparatus as claimed in claim 1, and means for selectively emplacing said barrier means in the path of a said arm.

3. Apparatus as claimed in claim 1, and a stationary barrier along said roadbed and having a rounded surface to contact the racer.

4. Apparatus as claimed in claim 1, said arms being integral with each other and being mounted for horizontal swinging movement on and relative to said racer about a single vertical axis.

5. Apparatus as claimed in claim 1, and a slider that slides longitudinally of the racer and projects rearwardly from the racer, said slider being operatively connected to said arms to shift said arms when another racer strikes said slider from behind and moves said slider forwardly.

6. A toy car racer in combination with a roadbed on which said toy car racer travels in random contacts with upright side guide walls provided along opposite marginal sides of the roadbed, the racer having a pair of driven wheels and a pair of steerable wheels, a slider mounted on the racer for sliding movement lengthwise of the racer to a rearwardly extended position in which said slider may be contacted by another racer from behind, and means interconnecting said slider and said steerable wheels to swing said steerable wheels upon forward sliding movement of said slider.

7. Apparatus as claimed in claim 6, said slider as seen from above comprising an open U-shaped frame having a rearward crosspiece and a pair of legs extending forwardly from said crosspiece and slidably mounted on said racer.

8. Apparatus as claimed in claim 6, and a pair of retractable arms mounted for horizontal swinging movement on said racer between a position in which one of said arms extends to one side of said racer and another position in which the other of said arms extends to the other side of said racer, said arms being interconnected with said steerable wheels to swing said wheels upon swinging movement of said arms, and means slidably interconnecting said slider and said arms for conjoint swinging movement of said arms and sliding movement of said slider.

* * * * *